US011241726B2

(12) United States Patent
Goto et al.

(10) Patent No.: US 11,241,726 B2
(45) Date of Patent: Feb. 8, 2022

(54) HOT-ROLLED STEEL SHEET AND METHOD FOR MANUFACTURING SAME

(71) Applicant: JFE STEEL CORPORATION, Tokyo (JP)

(72) Inventors: Hiroto Goto, Tokyo (JP); Yukio Kimura, Tokyo (JP); Satoshi Ueoka, Tokyo (JP); Nobuo Nishiura, Tokyo (JP); Sonomi Shirasaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 593 days.

(21) Appl. No.: 15/765,557

(22) PCT Filed: Nov. 18, 2016

(86) PCT No.: PCT/JP2016/084269
§ 371 (c)(1),
(2) Date: Apr. 3, 2018

(87) PCT Pub. No.: WO2017/090528
PCT Pub. Date: Jun. 1, 2017

(65) Prior Publication Data

US 2019/0076896 A1 Mar. 14, 2019

(30) Foreign Application Priority Data

Nov. 25, 2015 (JP) ..... JP2015-229755

(51) Int. Cl.
*B21C 47/18* (2006.01)
*B21B 1/26* (2006.01)
(Continued)

(52) U.S. Cl.
CPC ..... *B21B 1/26* (2013.01); *B21B 37/72* (2013.01); *B21B 1/38* (2013.01); *B21B 15/0007* (2013.01);
(Continued)

(58) Field of Classification Search
CPC ..... B21B 1/26; B21B 1/38; B21B 15/0007; B21B 37/72; B21B 2001/225;
(Continued)

(56) References Cited

U.S. PATENT DOCUMENTS

2010/0059149 A1* 3/2010 Yokoi ..... C21D 6/005 148/602
2016/0289788 A1 10/2016 Shibata et al.
2017/0182534 A1 6/2017 Goto et al.

FOREIGN PATENT DOCUMENTS

CN 101845596 A 9/2010
JP S59-174209 A 10/1984
(Continued)

OTHER PUBLICATIONS

Mar. 4, 2019 Chinese Office Action issued in Chinese Patent Application No. 201680069876.9.
(Continued)

*Primary Examiner* — Daniel J. Schleis
*Assistant Examiner* — Kevin C T Li
(74) *Attorney, Agent, or Firm* — Oliff PLC

(57) ABSTRACT

A hot-rolled steel sheet not exceeding a coil opener allowable load during unwinding includes a steel sheet cut in unsteady portions at its longitudinal head and tail ends in a cutting step after a rough rolling step, having a width of 1,200 mm to 2,300 mm, a thickness of 13 mm to 25.4 mm, and at least an API standard X65-grade strength, and used in a state of being unwound after having been wound around a coil. A longitudinal end corresponding to the unwinding start includes a portion at its widthwise center recessed inwards in the longitudinal direction with respect to its two widthwise ends, the two widthwise ends projection sizes with respect to the recessed portion at the widthwise center are 20
(Continued)

to 295 mm, and the sum of the widths of projecting portions at the two widthwise ends is set to ¼ to ½ of the sheet width.

3 Claims, 6 Drawing Sheets

(51) Int. Cl.

| | |
|---|---|
| ***B21B 15/00*** | (2006.01) |
| ***B21B 37/72*** | (2006.01) |
| *B21B 1/38* | (2006.01) |
| *B21B 1/22* | (2006.01) |
| *C21D 8/02* | (2006.01) |

(52) U.S. Cl.
CPC . *B21B 2001/225* (2013.01); *B21B 2015/0014* (2013.01); *B21B 2015/0064* (2013.01); *B21B 2263/20* (2013.01); *B21C 47/18* (2013.01); *C21D 8/0226* (2013.01); *C21D 8/0263* (2013.01)

(58) Field of Classification Search
CPC .... B21B 2015/0014; B21B 2015/0064; B21B 2263/202; B21C 47/18; C21D 8/0226; C21D 8/0263
See application file for complete search history.

(56) References Cited

FOREIGN PATENT DOCUMENTS

| | | | | | |
|---|---|---|---|---|---|
| JP | 59176864 | A | * | 11/1984 | ..... G06F 15/177 |
| JP | S62-173115 | A | | 7/1987 | |
| JP | H09-225527 | A | | 9/1997 | |
| JP | 5353260 | B2 | * | 11/2013 | |
| JP | 2014-176864 | A | | 9/2014 | |
| JP | 2014176864 | A | * | 9/2014 | |
| JP | 2015-101781 | A | | 6/2015 | |
| WO | 2015/182051 | A1 | | 12/2015 | |

OTHER PUBLICATIONS

Feb. 7, 2017 International Search Report issued in International Patent Application No. PCT/JP2016/084269.
May 29, 2018 International Preliminary Report on Patentability issued in International Patent Application No. PCT/JP2016/084269.
Apr. 2, 2019 Japanese Office Action issued in Japanese Patent Application No. 2017-552390.
Aug. 13, 2019 Office Action issued in Korean Patent Application No. 10-2018-7011468.
Jul. 24, 2019 Office Action issued in Chinese Patent Application No. 201680069876.9.

* cited by examiner

HOT-ROLLED STEEL SHEET AND METHOD FOR MANUFACTURING SAME

TECHNICAL FIELD

The present invention relates to a hot-rolled steel sheet which is rolled by rough rolling and cut in unsteady portions at its longitudinal head and tail ends, and a method for manufacturing the same and, more particularly, to such technologies suitable for a thick, wide, high-strength hot-rolled steel sheet.

BACKGROUND ART

Electric resistance welded steel pipes or spiral steel pipes made of hot-rolled steel sheets are used for pipelines which transport crude oil and natural gas. Hot-rolled steel sheets for line pipe materials of this type require high-strength, extremely thick specifications in terms of efficient transportation of, for example, crude oil and natural gas. Furthermore, since pipelines may be laid in seismic zones, the line pipe materials also need to be tough. Such hot-rolled steel sheets for line pipe materials need to satisfy, for example, X65-grade strength stipulated by API (American Petroleum Institute) standards, and examples of such hot-rolled steel sheets include a hot-rolled steel sheet disclosed in PTL 1. A hot-rolled steel sheet for a line pipe material, as disclosed in PTL 1, is generally thick, wide, and strong.

CITATION LIST

Patent Literature

PTL 1: JP 2015-101781 A

SUMMARY OF INVENTION

Technical Problem

A hot-rolled steel sheet for a line pipe material is once wound around a coil, which is then unwound to form a steel pipe. The coil of the hot-rolled steel sheet is unwound by a coil opener, but since such a hot-rolled steel sheet for a line pipe material is extremely thick, wide, and strong, the allowable load of the coil opener may be exceeded during this unwinding.

The present invention has been made in consideration of the above-described problem, and has as its object to provide a hot-rolled steel sheet which does not exceed the allowable load of a coil opener during unwinding, even with a coil of a thick, wide, high-strength hot-rolled steel sheet, and a method for manufacturing the same.

Solution to Problem

To solve the above-described problem, the inventors of the present invention conducted a close examination for a hot-rolled steel sheet which facilitates unwinding by a coil opener by shaping a crop portion formed on the trailing end of the steel sheet in the transport direction in a rough rolling step before finish rolling into a fish tail-shaped structure, and cutting the intermediate portion between the bottom of a recess and the tips of projections in the fish tail-shaped structure to form a recess at the widthwise center of the unwinding end of the hot-rolled steel sheet in the wound coil.

A coil is generally unwound by picking up and bending the rearmost end of a hot-rolled steel sheet by a coil opener. In this case, when the hot-rolled steel sheet has a small width, the coil opener can easily cause pickup deformation and bending deformation. In a rough rolling step before finish rolling, a crop portion formed on the trailing end of the steel sheet in the transport direction can be shaped into a fish tail-shaped structure as illustrated in FIG. 6A. Then, as illustrated in FIG. 7, when the intermediate portion between the bottom of a recess and the tips of projections in the fish tail-shaped structure is cut by a crop shear, the trailing end of the hot-rolled steel sheet can be formed with its widthwise center recessed more than its two widthwise ends.

An error occurs between the target cut position and the position where the blade of the crop shear actually comes into contact with the steel sheet, and, therefore, depending on the cut position accuracy of the crop shear, swinging down the blade of the crop shear while aiming at the target cut position of the fish tail-shaped crop portion, may result in full-width sheet cutting or a cutting miss because of a failure of contact with the fish tail-shaped structure of the crop portion. Under the circumstances, the fish tail length is set large enough to cause neither full-width sheet cutting nor a cutting miss even when an error occurs between the target cut position and the actual cut position.

Again, since an error occurs between the target cut position and the position where the blade of the crop shear actually comes into contact with the steel sheet, the target cut position needs to be set in consideration of the error. The target cut position needs to be set to allow the blade of the crop shear to be swung down with neither full-width sheet cutting nor a cutting miss even when the cut position of the crop shear deviates from the target cut position.

The present invention has been made based on the above-mentioned finding and includes the following gist.

To solve the above-described problem, the present invention inane aspect provides a hot-rolled steel sheet cut in unsteady portions at a longitudinal head end and a longitudinal tail end in cutting after rough rolling, having a width of 1,200 mm to 2,300 mm, a thickness of 13 mm to 25.4 mm, and at least an API standard X65-grade strength, and used in a state of being unwound after having been wound around a coil, wherein at least a longitudinal end corresponding to start of unwinding includes a portion at a widthwise center recessed inwards in a longitudinal direction with respect to two widthwise ends, projection sizes of the two widthwise ends with respect to the recessed portion at the widthwise center are 20 mm to 295 mm, and a sum of widths of projecting portions at the two widthwise ends is ¼ to ½ of the width of the sheet.

The present invention in another aspect provides a method for manufacturing a hot-rolled steel sheet, the method including: rough rolling; finish rolling; and winding, in which the steel sheet cut by a crop shear in a crop portion on a trailing end of the steel sheet in a transport direction after the rough rolling and before the finish rolling, finish-rolled in the finish rolling, and wound in the winding has a width of 1,200 mm to 2,300 mm, a thickness of 13 mm to 25.4 mm, and at least an API standard X65-grade strength, wherein in the rough rolling, the crop portion formed on the trailing end of the steel sheet in the transport direction is shaped into a fish tail-shaped structure by width reduction rolling using a width rolling mill and horizontal rolling using a horizontal rough rolling mill, and shaping is performed so that a minimum length L (mm) from a bottom of a recess to a tip of a projection in the fish tail-shaped structure satisfies:

$$(2X+5) \leq L \leq 300 \quad (1)$$

for $0 \leq X \leq 90$ where X is a maximum error (mm) of a cut position of the crop shear, and an intermediate portion between the bottom of the recess and the tip of the projection is cut as a target cut position.

Advantageous Effects of Invention

According to the present invention, even a coil of a thick, wide, high-strength steel sheet can be prevented from exceeding the allowable load of a coil opener during unwinding. Further, the steel sheet can be stably unwound without any extensive equipment improvement such as reinforcement of the coil opener.

DESCRIPTION OF EMBODIMENTS

The following embodiments exemplify devices or methods for embodying the technical idea of the present invention, and the technical idea of the present invention does not limit, for example, the materials, shapes, structures, and arrangements of components to the following specific examples. Various changes can be made to the technical idea of the present invention within the technical scope defined by claims described in the scope of claims.

Figure 1:
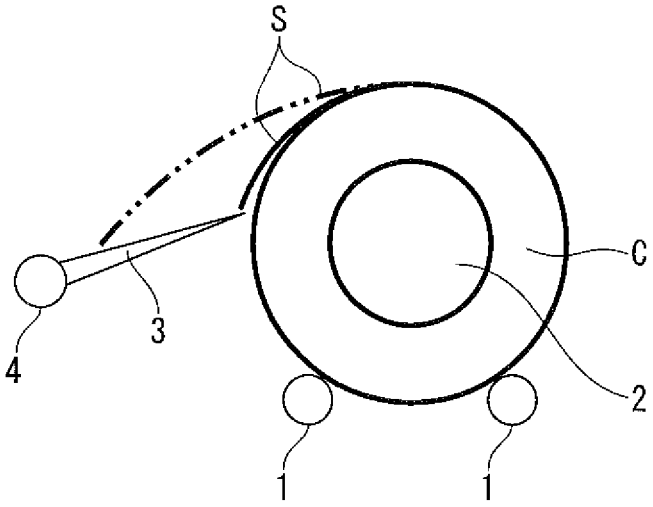
FIG. 1 is a front view illustrating a hot-rolled steel sheet coil as mounted on an uncoiler, as one embodiment of a hot-rolled steel sheet according to the present invention.
Figure 2:
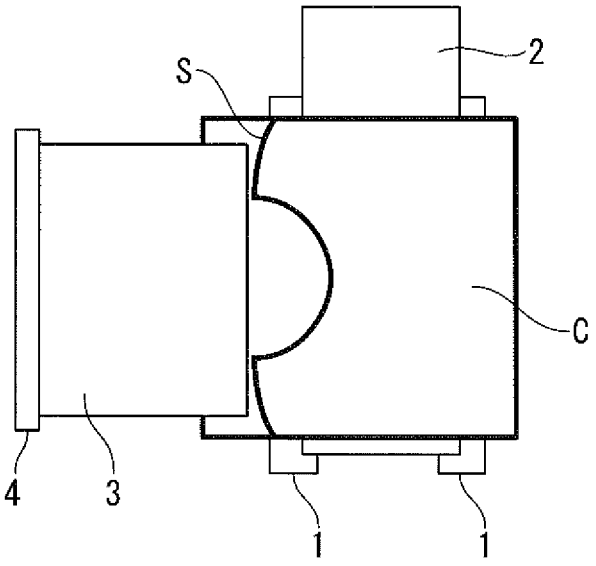
FIG. 2 is a plan view of the uncoiler illustrated in FIG. 1.

A hot-rolled steel sheet according to an embodiment of the present invention will be described below with reference to the drawings. FIG. 1 is a front view illustrating a hot-rolled steel sheet in this embodiment wrapped around a coil, as mounted on an uncoiler, and FIG. 2 is a plan view of the uncoiler illustrated in FIG. 1. The uncoiler includes cradle rollers 1 which support a coil C of a hot-rolled steel sheet S, a payoff reel 2 inserted into the coil C, and a coil opener 3 inserted at the unwinding end of the hot-rolled steel sheet S wound around the coil C. The payoff reel 2 and the cradle rollers 1 are rotated by motors (not illustrated) and the coil C of the hot-rolled steel sheet S thus can rotate.

The coil opener 3 in this embodiment is made of a wide, tapered sheet material and has its proximal end supported by a rotating shaft 4. Therefore, the distal end of the coil opener 3 can be rotated by rotating the rotating shaft 4. The coil opener 3 can be brought close to or moved away from the hot-rolled steel sheet coil C by a moving device (not illustrated). As will be described later, the hot-rolled steel sheet S can be unwound by catching the distal end of the coil opener 3 on the unwinding end of the hot-rolled steel sheet S wound around the coil C, and in this state, rotating the coil C using the payoff reel 2 and the cradle rollers 1. The coil opener 3 is in the so-called cantilevered state and has an upper limit in load imposed on the rotating shaft 4.

Figure 3A:
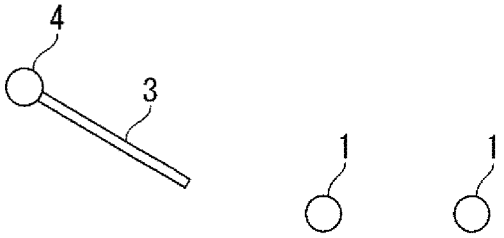
FIGS. 3A to 3E illustrate views for explaining the start of unwinding by a coil opener.
Figure 3B:
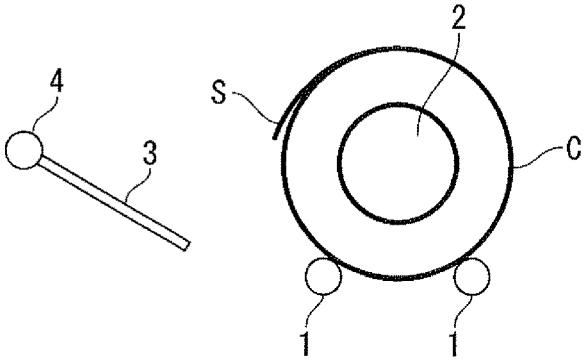
Figure 3C:
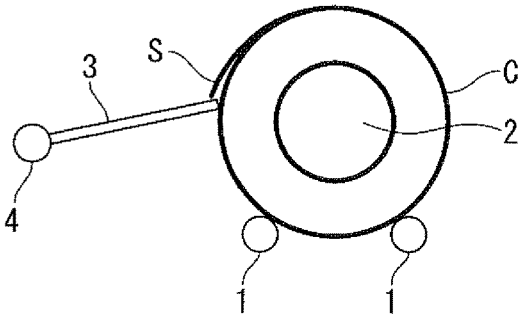
Figure 3D:
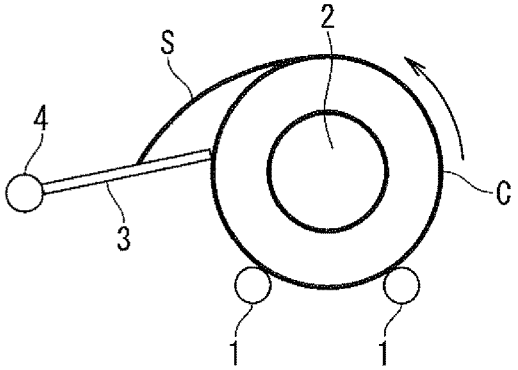
Figure 3E:
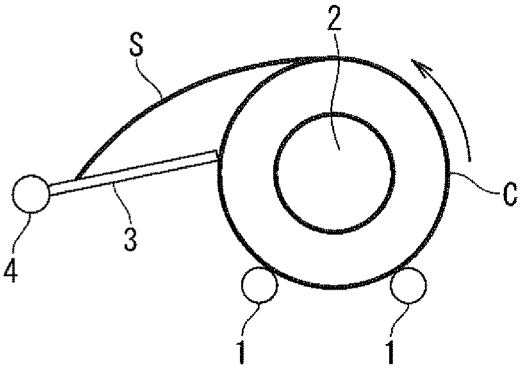

FIGS. 3A to 3E illustrate views for explaining the start of unwinding of the hot-rolled steel sheet coil C by an uncoiler. First, the coil opener 3 is moved away and the payoff reel 2 of the uncoiler is retracted, as illustrated in FIG. 3A, and the hot-rolled steel sheet coil C is mounted on the cradle rollers 1 in this state, as illustrated in FIG. 3B. The payoff reel 2 is then inserted into the hot-rolled steel sheet coil C, and the coil opener 3 is brought close to the hot-rolled steel sheet coil C to catch its distal end on the unwinding end of the coil C, as illustrated in FIG. 3C. In this state, when the coil C is rotated by the payoff reel 2 and the cradle rollers 1, as illustrated in FIG. 3D, the unwinding end of the coil C is unwound and the hot-rolled steel sheet S is pulled out, as illustrated in FIG. 3E.

Figure 5:
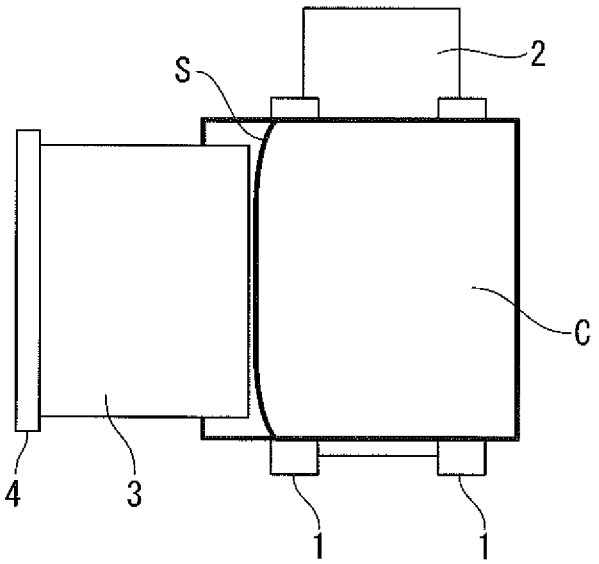
FIG. 5 is a plan view illustrating a general hot-rolled steel sheet coil as mounted on an uncoiler.

In this uncoiler, the coils of various hot-rolled steel sheets S are unwound, including hot-rolled steel sheets S for line pipe materials. FIG. 5 is a plan view illustrating a coil C of a general hot-rolled steel sheet S as mounted on an uncoiler. In the coil C of the general hot-rolled steel sheet S, the wound hot-rolled steel sheet S has a nearly linear longitudinal end. In contrast to this, a hot-rolled steel sheet S for a line pipe material is extremely thick, wide, and strong, and a heavy load is imposed on the coil opener 3 when the hot-rolled steel sheet S for a line pipe material wound around the coil C is unwound, as described earlier. Hence, in this embodiment, the coil unwinding end of the hot-rolled steel sheet S for a line pipe material is formed with its widthwise center recessed inwards in the longitudinal direction with respect to its two widthwise ends, as illustrated in FIG. 2.

Figure 4:
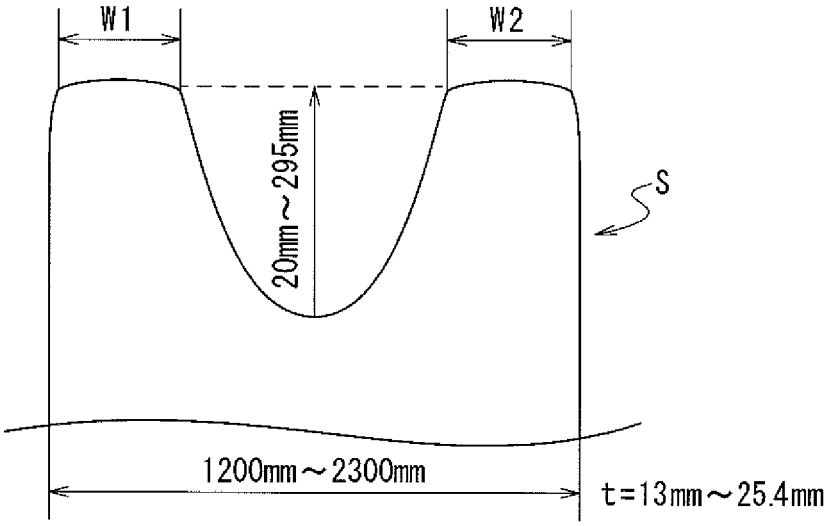
FIG. 4 is a diagram for explaining the shape of a longitudinal end corresponding to the start of unwinding of the hot-rolled steel sheet illustrated in FIG. 2.

FIG. 4 illustrates details of the shape of the longitudinal end of the hot-rolled steel sheet S for a line pipe material. The hot-rolled steel sheet S for a line pipe material has specifications; Width: 1,200 mm to 2,300 mm; Thickness: 13 mm to 25.4 mm; and Strength: API Standard X65-grade or more. The hot-rolled steel sheet S is cut in unsteady portions at its longitudinal head and tail ends, that is, so-called crop portions in the cutting step, and is used in a state of being unwound after having been wound around the coil C. At least a longitudinal end corresponding to the start of unwinding is formed with a portion at its widthwise center recessed inwards in the longitudinal direction with respect to its two widthwise ends. The projection sizes of the two widthwise ends with respect to the recessed portion at the widthwise center are 20 mm to 295 mm, and the sum of the widths W1 and W2 of projecting portions at the two widthwise ends is ¼ to ½ of the sheet width.

To form the longitudinal end of the hot-rolled steel sheet S with its widthwise center recessed inwards in the longitudinal direction with respect to its two widthwise ends in the above-mentioned manner, an unsteady portion of the longitudinal end of the steel sheet, that is, a crop portion is shaped into a fish tail-shaped structure by rough rolling. When the crop portion of the steel sheet is shaped into a fish tail-shaped structure, for example, the steel sheet is reduced in width by a width rolling mill in the rough rolling step and is then rolled by a horizontal rolling mill. A sizing press may be substituted for the width rolling mill. The fish tail-shaped crop portion is cut by a crop shear at a position 20 mm to 295 mm from the recess of the widthwise center. Since a crop shape meter which detects the shape of the crop portion is provided in the rough rolling step, the cut position of a crop shear need only be determined in accordance with the shape of the crop portion detected by the crop shape meter.

The hot-rolled steel sheet S wound around the coil C is unwound by plastically deforming the hot-rolled steel sheet S. With this plastic deformation, when the sheet thickness is equal, the larger the sheet width, the larger the cross-sectional area, and the heavier the load imposed on the rotating shaft 4 of the coil opener 3. The load imposed on the rotating shaft 4 of the coil opener 3 is heaviest at the start of unwinding as the moment arm is longest. Therefore, forming a portion at the widthwise center recessed inwards in the longitudinal direction with respect to the two widthwise ends can reduce the cross-sectional area and, in turn, can reduce the load imposed on the rotating shaft 4 of the coil opener 3 during unwinding. When the cross-sectional area is equal, the longitudinal end of the hot-rolled steel sheet may even be formed with its widthwise center projecting outwards in the longitudinal direction with respect to its two widthwise ends. However, in such a shape, the load concentrates on the rotating shaft 4 of the coil opener 3. When the longitudinal end of the hot-rolled steel sheet S is formed with its widthwise center recessed with respect to its two widthwise ends, the load imposed on the rotating shaft 4 of the coil opener 3 can be distributed and prevented from exceeding its upper limit accordingly.

As described above, the hot-rolled steel sheet S in this embodiment is cut in unsteady portions at its longitudinal head and tail ends in a cutting step after a rough rolling step, has a width of 1,200 mm to 2,300 mm, a thickness of 13 mm to 25.4 mm, and at least an API standard X65-grade strength, and is used in a state of being unwound after having been wound around the coil. At least a longitudinal end corresponding to the start of unwinding is formed with a portion at its widthwise center recessed inwards in the longitudinal direction with respect to its two widthwise ends, the projection sizes of the two widthwise ends with respect to the recessed portion at the widthwise center are set to 20 mm to 295 mm, and the sum of the widths W1 and W2 of projecting portions at the two widthwise ends is set to ¼ to ½ of the sheet width. This can prevent even the coil C of a thick, wide, high-strength steel sheet from exceeding the allowable load of the coil opener 3 during unwinding of the hot-rolled steel sheet S. Further, the steel sheet can be stably unwound without any extensive equipment improvement such as reinforcement of the coil opener 3. When the above-mentioned projection sizes are smaller than 20 mm, the sheet may be cut over the entire width and the allowable load of the coil opener 3 may be exceeded during unwinding of the hot-rolled steel sheet S. When these projection sizes are larger than 295 mm, the projecting portions at the two widthwise ends may wrinkle during unwinding and the front end cannot be satisfactorily removed. When the sum of the widths W1 and W2 of the projecting portions at the two widthwise ends is set smaller than ¼ of the sheet width, the projecting portions at the two widthwise ends may wrinkle during unwinding and the front end cannot be satisfactorily removed. When the sum of the widths W1 and W2 of the projecting portions at the two widthwise ends is set larger than ½ of the sheet width, the sheet may be cut over the entire width and the allowable load of the coil opener 3 may be exceeded during unwinding of the hot-rolled steel sheet S.

A method for manufacturing a hot-rolled steel sheet according to the above-described embodiment will be described below. The steps of manufacturing a hot-rolled steel sheet are defined as the steps of manufacturing a steel strip from a slab and roughly classified into heating, rough rolling, finish rolling, cooling, and winding steps in the order of execution. The following description assumes the heating step side as the upstream side and the winding step side as the downstream side.

In the heating step, a slab is heated to 1, 100° C. to 1, 300° C. in a heating furnace and extracted on a table for transportation to the subsequent steps.

In the rough rolling step, width reduction rolling and horizontal rolling are performed on the transported slab by a width rolling mill and a rough rolling mill each including at least a pair of rollers. The width rolling mill is provided on each or either of the upstream and downstream sides of the rough rolling mill. Width reduction rolling and horizontal rolling may be performed forwards to the downstream step side or backwards to the upstream step side. In the rough rolling step, further, when width reduction rolling and horizontal rolling may be performed only forwards or by at least two repetitions of forward and backward operations. In the rough rolling step, the slab is formed into a sheet bar having a predetermined sheet width and thickness by the above-mentioned operations.

In the rough rolling step, a sizing press for reducing the width of the slab may be located upstream of the rough rolling mill. The sizing press is greater in efficiency of slab width reduction than the width rolling mill and is therefore used in considerably reducing the width of the slab.

In the finish rolling step, horizontal rolling is performed on the sheet bar using a finish rolling mill including at least one horizontal rolling mill including a pair of upper and lower rollers. Horizontal rolling is performed in one direction in this case.

In the cooling step, the transported steel sheet after finish rolling is cooled by spraying water onto it from the upper and lower positions.

In the winding step, the cooled steel sheet is wound into a cylindrical shape by a coiler.

Figure 6A:
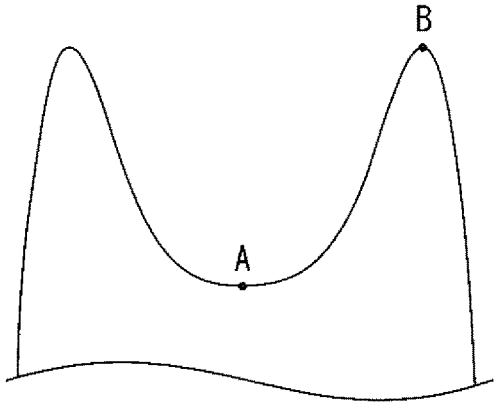
FIGS. 6A to 6D illustrate schematic views of the planar shapes of crop portions formed on the leading and trailing ends of the steel sheet in the transport direction.
Figure 6B:
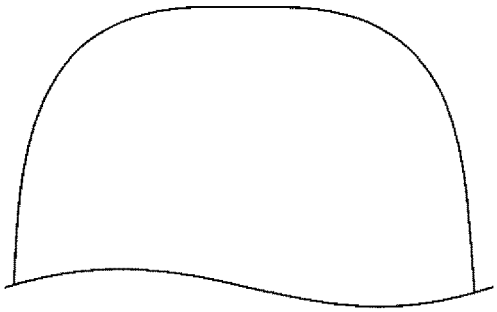
Figure 6C:
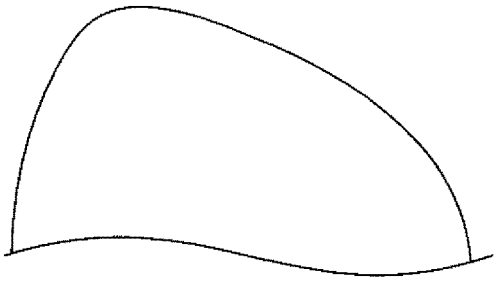
Figure 6D:
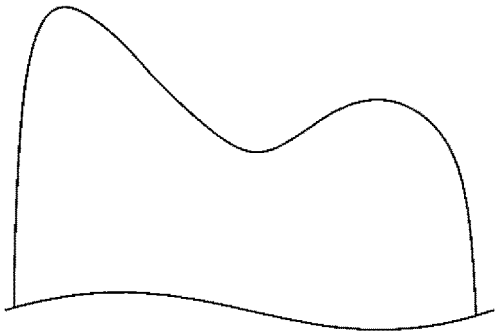

The sheet bar means a steel sheet after the end of a rough rolling step and before finish rolling. The trailing end of the sheet bar in the transport direction is deformed into various forms by horizontal rolling and width reduction rolling in the rough rolling step and width reduction rolling by a sizing press to form crop portions. For example, a tongue-shaped crop portion having a sheet widthwise center elongated in the rolling direction with respect to the sheet widthwise ends is available, as illustrated in FIG. 6B. A fish tail-shaped crop portion having sheet widthwise ends elongated in the rolling direction with respect to the sheet widthwise center, as illustrated in FIG. 6A, is also available. Bilaterally asymmetrical crop portions may even be available, such as a bilaterally asymmetrical tongue-shaped crop portion as illustrated in FIG. 6C, and a bilaterally asymmetrical fish tail-shaped crop portion as illustrated in FIG. 6D.

Figure 7:
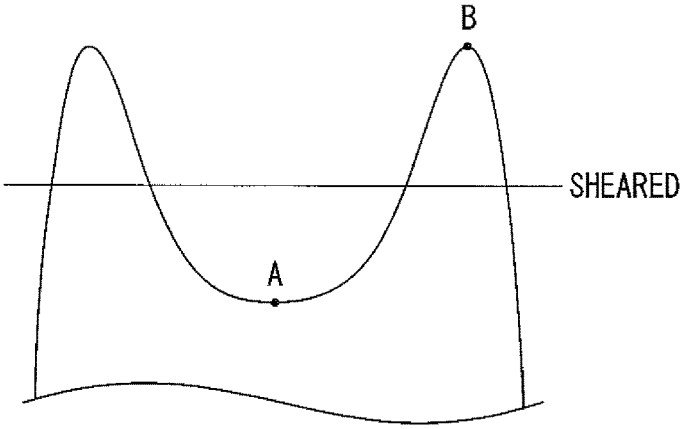
FIG. 7 is a schematic view illustrating the cut position of the crop.

The crop portion on the trailing end of a sheet bar in the transport direction can be formed into a desired shape by adjusting the amount of width reduction by a width rolling mill and the amount of rolling by a horizontal rough rolling mill in a rough rolling step, the number of passes in the rough rolling step, and the amount of width reduction by a sizing press. In the present invention, to form the trailing end of a hot-rolled steel sheet in the transport direction after crop portion cutting with its widthwise center recessed with respect to its two widthwise ends, the crop portion on the trailing end of the sheet bar in the transport direction is formed into a fish tail-shaped structure as illustrated in FIG. 6A, and the intermediate portion between the tips of projections and the bottom of a recess in the fish tail-shaped structure is cut, as illustrated in FIG. 7.

Generally, the crop portions on the leading and trailing ends of a sheet bar in the transport direction are cut on the entry side of a finish rolling mill. This cutting of the crop portions is done to stabilize threading during finish rolling. A crop shear for cutting the crop portions on the leading and trailing ends of a sheet bar in the transport direction is generally located on the entry side of a finish rolling mill, but it need only be located downstream of a rough rolling step and upstream of a finish rolling step, as long as the crop portions formed on the leading and trailing ends of a sheet bar in the transport direction in the rough rolling step can be cut. Although the schemes of cutting by crop shears are commonly roughly classified into three types: the guillotine, crank, and drum types, but any cutting scheme may be used as long as the crop portion on the trailing ends of a sheet bar in the transport direction can be cut in the widthwise direction.

When the sheet bar is cut by a crop shear, an error occurs between the target cut position and the position where the blade of the crop shear actually comes into contact with the sheet bar, and the maximum error X (mm) depends on the accuracy of tracking of the steel sheet and is generally 0 to 90 mm.

In view of this, to reliably cut the intermediate portion between the bottom of a recess and the tips of projections in the fish tail-shaped structure of the crop portion formed on the trailing end of the sheet bar in the transport direction, the minimum length L (mm) from the bottom of the recess to the tips of the projections in the fish tail-shaped structure is set to (2X+5) mm or more, and the upper limit of the minimum length L is set to 300 mm in terms of the product yield. In other words, shaping is performed so that the minimum length L (mm) from the bottom of the recess to the tips of the projections in the fish tail-shaped structure satisfies:

$$(2X+5) \leq L \leq 300 \quad (1)$$

for $0 \leq X \leq 90$ where X is the maximum error (mm) of the cut position of the crop shear.

When the minimum length L is smaller than (2X+5) mm, cutting the intermediate portion between the bottom of the recess and the tips of the projections in the fish tail-shaped structure as a target cut position may result in a cutting miss or full-width sheet cutting. When the minimum length L is larger than 300 mm, the projecting portions at the two widthwise ends may wrinkle during unwinding and the front end cannot be removed.

Figure 8A:
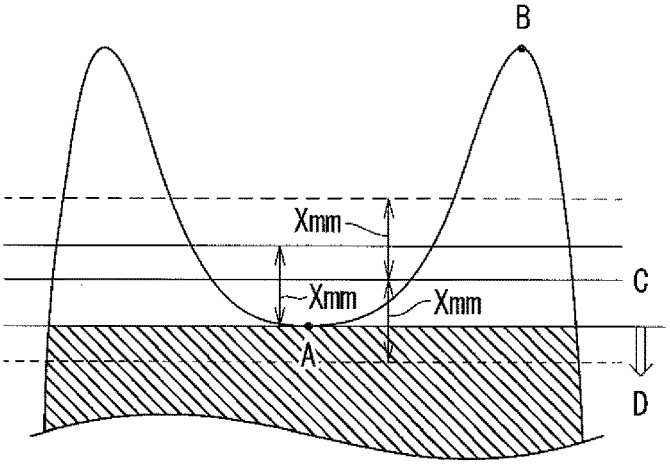
FIGS. 8A to 8B illustrate schematic diagrams of the errors between the target cut positions and the positions where the blade of a cutter actually comes into contact with the steel sheet.

As described earlier, when the sheet bar is cut by a crop shear, an error occurs between the target cut position of the sheet bar and the position where the blade of the crop shear actually comes into contact with the sheet bar, and the maximum error X depends on the accuracy of tracking of the sheet bar and is generally 0 to 90 mm. When the target cut position is set at a position less than X mm from the bottom of a recess to the tips of projections in the fish tail-shaped structure, if the position where the blade of the crop shear actually comes into contact with the sheet bar deviates from the target cut position toward the bottom of the recess by X mm, full-width sheet cutting may occur, as illustrated in FIG. 8A. Therefore, the target cut position is preferably set more to the tips of the projections than a position X mm from the bottom of the recess to the tips of the projections in the fish tail-shaped structure.

Figure 8B:
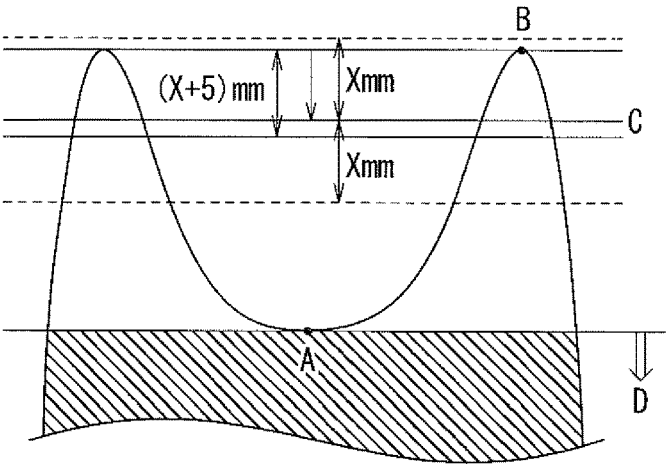

When the distance between the target cut position and the tips of the projections in the fish tail-shaped structure is (X+5) mm or less, as illustrated in FIG. 8B, if the position where the blade of the crop shear actually comes into contact with the sheet bar deviates from the target cut position toward the tips of the projections by X mm, a cutting miss may occur. Therefore, upon setting of a margin of 5 mm to prevent any cutting miss, the target cut position is preferably set more to the bottom of the recess than a position (X+5) mm from the tips of the projections to the bottom of the recess in the fish tail-shaped structure.

Figure 9:
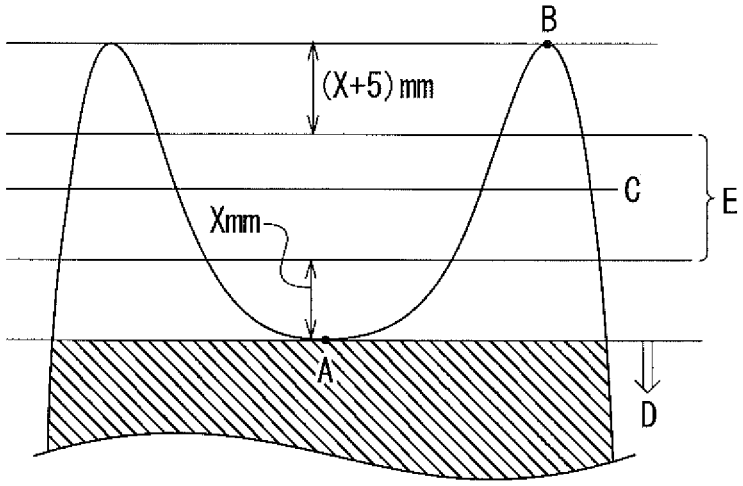
FIG. 9 is a schematic diagram illustrating the range in which the target cut position is set.

From the foregoing description, to cut the intermediate portion between the bottom of a recess and the tips of projections in the fish tail-shaped structure of the crop portion formed on the sheet bar, with neither full-width sheet cutting nor a cutting miss, the target cut position is preferably set between a position X mm from the bottom of the recess toward the tips of the projections in the fish tail-shaped structure and a position (X+5) mm from the tips of the projections toward the bottom of the recess. FIG. 9 illustrates a preferable range of the intermediate portion between the bottom of the recess and the tips of the projections in the fish tail-shaped structure, in which the target cut position is set. When the target cut position is set in the above-mentioned manner, even if the error between the target cut position and the position where the blade of the crop shear actually comes into contact with the sheet bar reaches the maximum error X (mm), cutting can be performed with neither full-width sheet cutting nor a cutting miss.

EXAMPLE

To manufacture a hot-rolled steel sheet for a line pipe material having a thickness of 25 mm, a width of 1,500 mm, and at least an API standard X65-grade strength, a sheet bar having a thickness of 60 mm, a width of 1,500 mm, and a finish rolling mill entry-side temperature of 900° C. was processed under various manufacturing conditions in a rough rolling step to form sheet bars having various planar shapes, the trailing ends of the sheet bars in the transport direction were cut by a crop shear in front of a finish rolling mill to form coils, and it was determined whether hot-rolled steel sheets wound around the coils could be unwound. In this case, the maximum error of the cut position of the crop shear was 90 mm. Table 1 represents unwinding results. For Nos. 1 and 2 in Table 1, since the length L from the bottom of a recess to the tips of projections in a fish tail-shaped structure ("Projection Size" in Table 1) is small, each sheet was cut over the entire width, as in the conventional technologies. Therefore, the load imposed on a coil opener was too heavy to allow unwinding. For Nos. 3 to 5 in Table 1, since the length L from the bottom of a recess to the tips of projections in a fish tail-shaped structure is large, and cutting was performed in consideration of the error of the cut position, the trailing end of each hot-rolled steel sheet (the coil tail end in the drawings) could be formed with its widthwise center recessed with respect to its two widthwise ends, and since the sum of the widths W1 and W2 of projecting portions at the two widthwise ends was set to ¼ to ½ of the sheet width, unwinding could be performed while reducing the load imposed on the coil opener.

For No. 6, since the length L from the bottom of a recess to the tips of projections in a fish tail-shaped structure is small, and the sheet was cut at a position close to the bottom of the recess, the trailing end of the hot-rolled steel sheet could be formed with its widthwise center recessed with respect to its two widthwise ends, but since the sum of the widths W1 and W2 of projecting portions at the two widthwise ends is larger than ½ of the sheet width, the load imposed on the coil opener could not be sufficiently reduced, resulting in a failure of unwinding.

For No. 7, since the length L from the bottom of a recess to the tips of projections in a fish tail-shaped structure is small, and the sheet was cut at a position close to the tips of the projections, the trailing end of the hot-rolled steel sheet could be formed with its widthwise center recessed with respect to its two widthwise ends, but since the sum of the widths W1 and W2 of projecting portions at the two widthwise ends is smaller than ¼ of the sheet width, the front end of the coil wrinkled during unwinding by the coil opener, resulting in a failure of unwinding.

TABLE 1

| Steel Sheet No. | Projection Size from Bottom of Recess [mm] | Shape of Coil Tail End | W1 [mm] | W2 [mm] | Unwinding | Note |
|---|---|---|---|---|---|---|
| 1 | 10 | Rectangle | — | — | x | Comparative Example |
| 2 | 50 | Rectangle | — | — | x | Comparative Example |
| 3 | 100 | Recessed at Widthwise Center | 300 | 400 | ○ | Inventive Example |
| 4 | 200 | Recessed at Widthwise Center | 250 | 300 | ○ | Inventive Example |
| 5 | 290 | Recessed at Widthwise Center | 200 | 200 | ○ | Inventive Example |
| 6 | 75 | Recessed at Widthwise Center | 400 | 450 | x | Comparative Example |
| 7 | 300 | Recessed at Widthwise Center | 150 | 200 | x | Comparative Example |

The present invention encompasses various embodiments and the like which are not described herein, as a matter of course. Accordingly, the technical scope of the present invention is defined only by specific matters of the invention described in the scope of claims appropriate from the foregoing description.

REFERENCE SIGNS LIST

1 . . . cradle roller
2 . . . payoff reel
3 . . . coil opener
4 . . . rotating shaft
C . . . coil
S . . . steel sheet

The invention claimed is:

1. A hot-rolled steel sheet having
a width that is in a range of from 1,200 mm to 2,300 mm,
a thickness that is in a range of from 13 mm to 25.4 mm,
a strength that is at least an API standard X65-grade strength,
a longitudinal head end, and
a longitudinal tail end,
wherein:
the hot-rolled steel sheet is cut in portions at the longitudinal head end and the longitudinal tail end after rough rolling,
at least one of the longitudinal head end and the longitudinal tail end includes two widthwise end portions and a recessed portion at a widthwise center, the recessed portion is recessed inwards in a longitudinal direction with respect to the two widthwise end portions,
in the longitudinal direction, a longitudinal height of each of the two widthwise end portions with respect to the recessed portion is in a range of from 20 mm to 295 mm,
a sum of widths of the two widthwise end portions is in a range of from ¼ to ½ of the width of the sheet, and
the hot-rolled steel sheet is configured to be used in an unwound state after having been wound around a coil.

2. A method for manufacturing the hot-rolled steel sheet according to claim 1, the method comprising:
rough rolling a steel sheet, the rough rolling includes width reduction rolling and horizontal rolling so as to shape a crop portion that is formed on a trailing end of the steel sheet in a transport direction into a fish tail-shaped structure such that a minimum length L (mm) from the recessed portion to a tip in the fish tail-shaped structure satisfies:

$$(2X+5) \leq L \leq 300 \quad (1)$$

where
X is a maximum error (mm) of a cut position of a crop shear, and $$0 \leq X \leq 90;$$

cutting the rough-rolled steel sheet with the crop shear in the crop portion such that the rough-rolled steel sheet is cut at a target cut position that is between the recessed portion and the tip;
finish rolling the cut steel sheet; and
winding the finished-rolled steel sheet.

3. The method according to claim 2, wherein the target cut position is set between a position X mm from the recessed position toward the tip and a position (X+5) mm from the tip of toward the recessed portion.

* * * * *